US007003998B1

(12) United States Patent
Smith

(10) Patent No.: US 7,003,998 B1
(45) Date of Patent: Feb. 28, 2006

(54) APPARATUS FOR FORMING A FLANGE AT THE END OF A CONDUIT

(76) Inventor: Philip E. Smith, 3732 Electro Way, Redding, CA (US) 96002

( * ) Notice: Subject to any disclaimer, the term of this patent is extended or adjusted under 35 U.S.C. 154(b) by 105 days.

(21) Appl. No.: 10/757,702

(22) Filed: Jan. 14, 2004

(51) Int. Cl.
*B21D 19/12* (2006.01)

(52) U.S. Cl. ..... 72/86; 72/101; 72/105; 72/109

(58) Field of Classification Search ..... 72/80, 72/86, 87, 101, 105, 106, 107, 109, 110, 111, 72/117, 118, 119, 120, 125
See application file for complete search history.

(56) References Cited

U.S. PATENT DOCUMENTS 2,016,735 A * 10/1935 Abramson ..... 72/71
2,975,819 A * 3/1961 Costanzo et. al. ..... 72/124
3,050,102 A * 8/1962 Hock ..... 72/117
3,196,655 A * 7/1965 Hedgecock et al. ..... 72/101
3,451,243 A * 6/1969 Gallinger ..... 72/124
3,473,359 A * 10/1969 Joslin ..... 72/121
3,748,933 A * 7/1973 De Shazor ..... 82/113
3,867,824 A * 2/1975 Takagi et al. ..... 72/118
6,666,062 B1 * 12/2003 Dole et al. ..... 72/121

* cited by examiner

*Primary Examiner*—Ed Tolan
(74) *Attorney, Agent, or Firm*—Thomas R. Lampe

(57) ABSTRACT

Apparatus for shaping a conduit to form a radially outwardly projecting flange at an end thereof includes a holding fixture, a collar surrounding the conduit disposed in an opening in the holding fixture, rotation imparting structure engaging the collar for simultaneously rotating the collar and the conduit and a flange forming tool connected to the holding fixture engaging a conduit end to apply bending forces to the conduit to form the flange when the conduit is rotated. The apparatus also includes a conduit cutter for cutting the conduit to form the end prior to flange formation.

9 Claims, 5 Drawing Sheets

APPARATUS FOR FORMING A FLANGE AT THE END OF A CONDUIT

TECHNICAL FIELD

This invention relates to apparatus employed to form a radially outwardly projecting flange at the end of a conduit. The conduit may, for example, be a riser employed to establish communication between an underground liquid storage tank and a location above ground. The apparatus can form the end by cutting the conduit prior to formation of the flange.

BACKGROUND OF THE INVENTION

It is sometimes desirable to form flanged ends an risers or other types of conduits. It is often advantageous to perform such modification at a work site. While flange forming machines are in existence, they are often characterized by their relatively large size and complexity, making them unsuitable for onsite work.

Then too, risers and other types of conduits may have irregular or damaged ends, making them unsuitable for formation of a flange which is smooth and can form a fluid-tight junction when connected to other elements. Therefore, it is desirable to provide a compact, easily usable arrangement for cutting the conduit to form a smooth undamaged end prior to formation of the flange. As will be seen below, the apparatus of the present invention has these capabilities and particularly lends itself to transport to and use at any site where the work is to be performed.

DISCLOSURE OF INVENTION

The present invention relates to apparatus which is compact in nature and readily transportable and usable at a job site. The apparatus inexpensively, efficiently and effectively shapes a conduit to form a radially outwardly projecting flange. It lends itself to manual operation.

The apparatus includes a holding fixture defining an opening receiving the conduit.

A collar is releasably attached to the conduit and surrounds the conduit, the collar being disposed in the opening and supported by the holding fixture.

The apparatus also includes rotation imparting structure operatively associated with the holding fixture engaging the collar and employed to simultaneously rotate the collar and the conduit.

A flange forming tool is connected to the holding fixture engaging the conduit at the end thereof and operable to apply bending forces to the conduit to form a radially outwardly extending flange at the end upon rotation of the collar and the conduit by the rotation imparting structure.

The apparatus additionally includes a conduit cutter connected to the holding fixture for cutting the conduit to form the end upon rotation of the collar and the conduit by the rotation imparting structure prior to formation of the flange by the flange forming tool.

Other features, advantages and objects of the present invention will become apparent with reference to the following description and accompanying drawings.

BEST MODE FOR CARRYING OUT THE INVENTION

Figure 1:
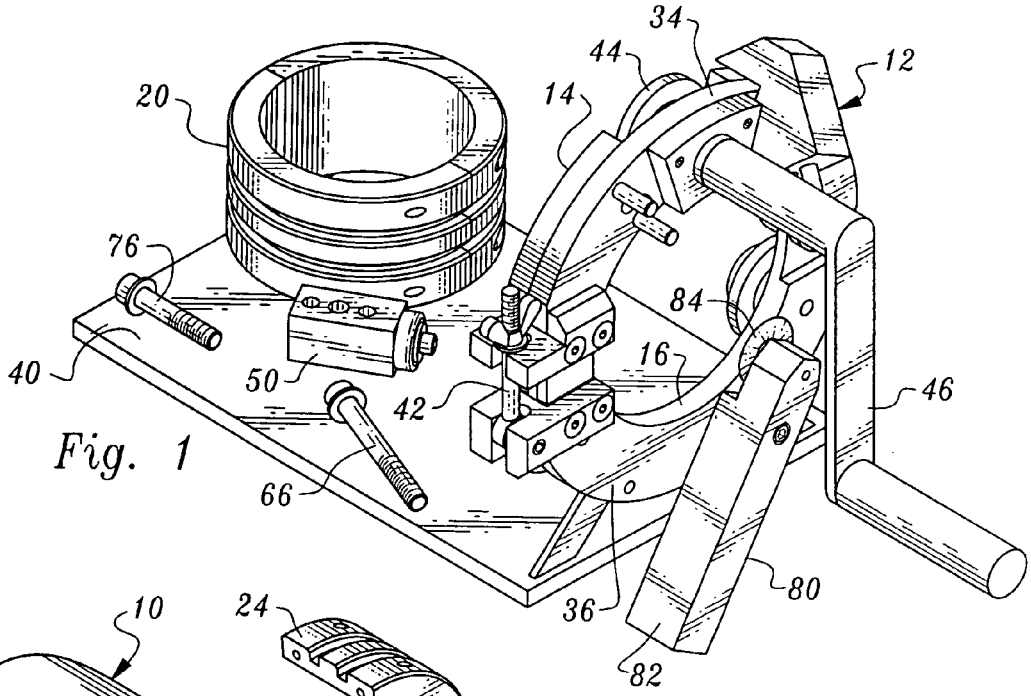
FIG. 1 is a rear, perspective view of structural elements of apparatus constructed in accordance with the teachings of the present invention unassembled.

The drawings show a riser 10 which apparatus 12 constructed in accordance with the present invention is employed to form a radially outwardly projecting flange at an end thereof. Rather than a riser, flanges on other types of conduits can also be formed by apparatus 12.

Apparatus 12 includes a holding fixture 14 defining an opening 16 for receiving the conduit 10.

Figure 3:
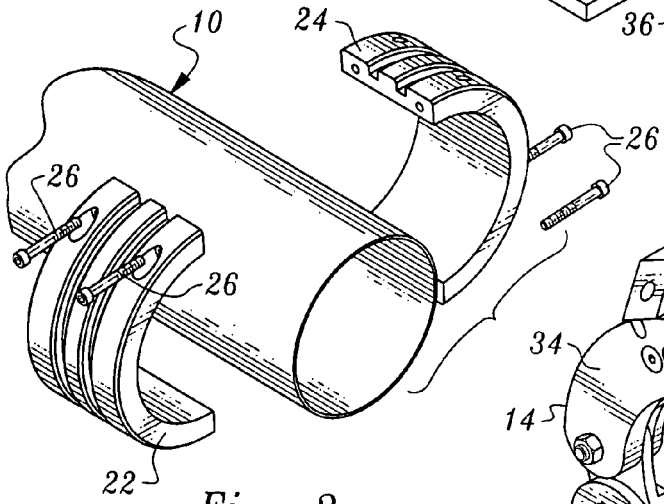
FIG. 3 is an exploded, perspective view showing a riser and unassembled collar segments prior to their attachment together to surround the conduit.
Figure 2:
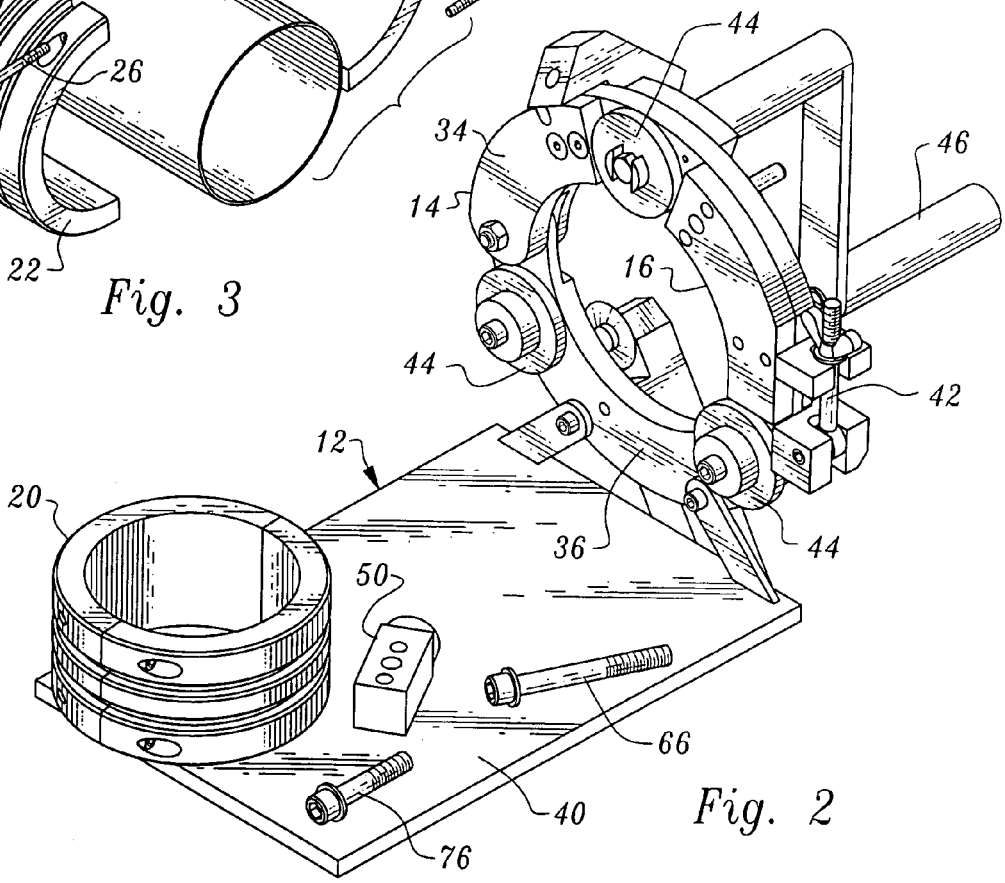
FIG. 2 is a front, perspective view of the apparatus showing the unassembled structural components thereof.

Prior to introducing the conduit 10 into opening 16, a collar 20 is releasably attached to the conduit to surround the conduit. The collar is disposed in opening 16 and supported by the holding fixture 14. The collar 20 comprises two collar segments 22, 24 (FIG. 3) releasably held together by threaded fasteners 26.

The collar 20 has an outer periphery 28 defining spaced circular indents 30, 32 extending about said outer periphery.

Holding fixture 14 includes fixture segments which are pivotally attached at pivot 38. Fixture segment 36 is fixedly attached to a support base 40 which may be placed on the ground or other support surface.

Figure 4:
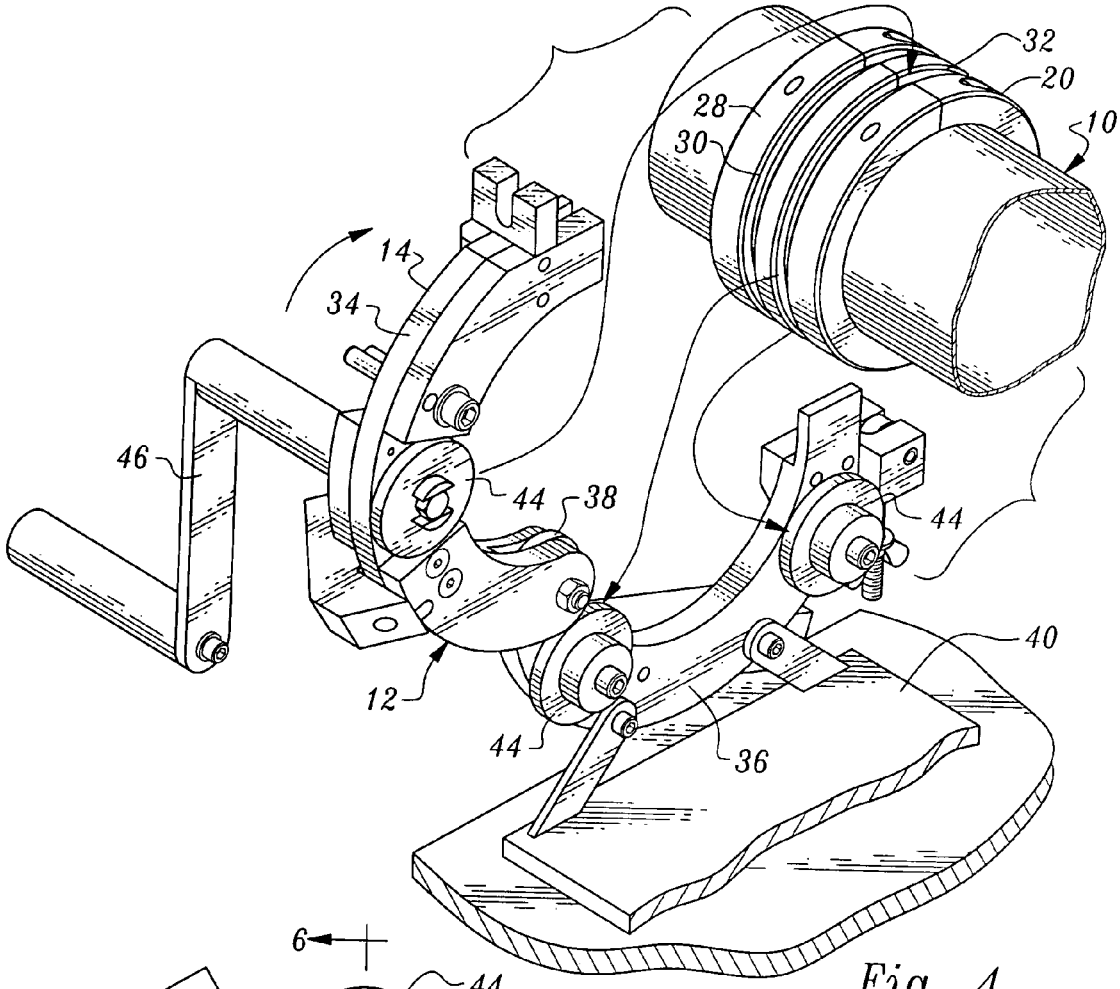
FIG. 4 is a front, perspective view illustrating the collar applied to the conduit and being placed into the holding fixture of the apparatus.
Figure 5:
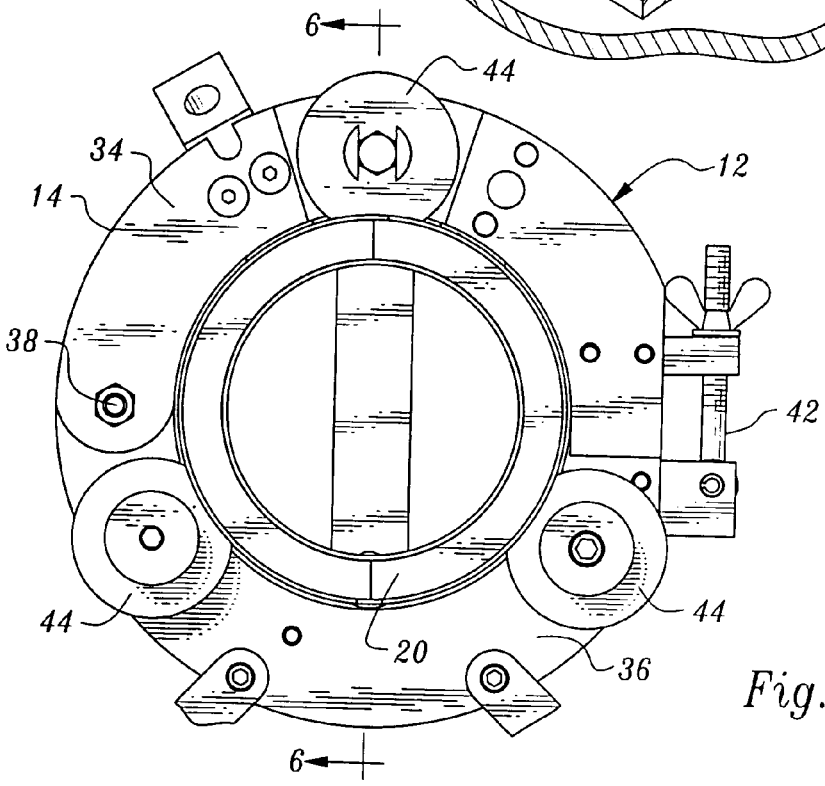
FIG. 5 is a front, elevational view showing the collar and conduit supported by the holding fixture.
Figure 6:
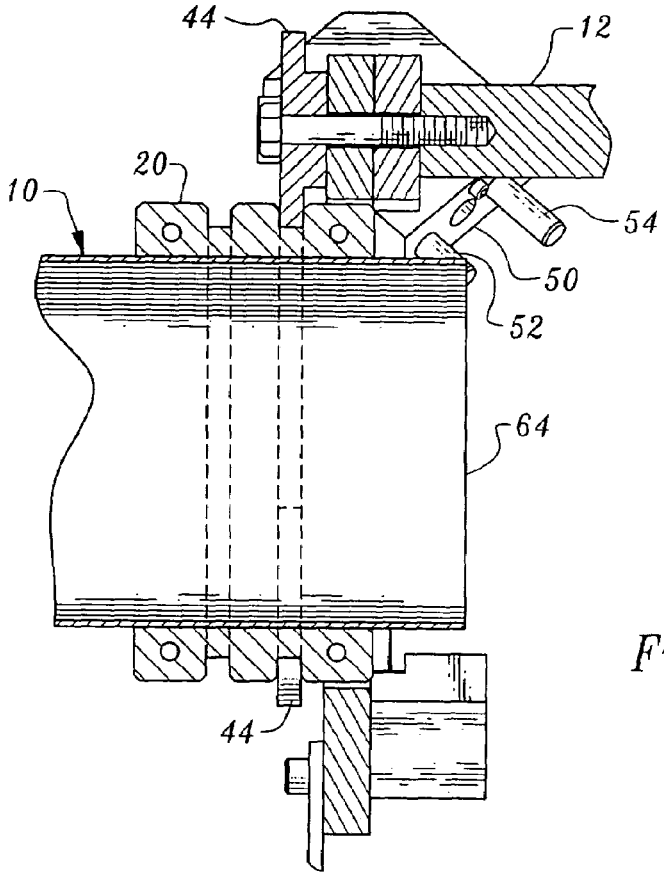
FIG. 6 is an enlarged, cross-sectional view taken along line 6—6 of FIG. 5.

The pivoted fixture segments 34, 36 are relatively movable between a first configuration (shown for example in FIG. 8) wherein the fixture segments completely surround the collar and the conduit and a second configuration (shown in FIG. 4, for example) wherein the fixture segments do not completely surround the collar and conduit. When the fixture segments are in the second configuration, the collar and conduit may readily be inserted in opening 16 or removed therefrom. A lock 42 is employed to lock the fixture segments in the first (or use) configuration.

Holding fixture 14 includes rotatable tracking wheels 44 which are located in one of the circular indents of the collar when the fixture segments are in their first configuration. As shown, the tracking wheels are disposed in and track in circular indent 32. A handle 46 is attached to one of the tracking wheels 44 and rotation of the handle and the associated tracking wheel result in rotation of the collar 20 and conduit 10.

Figure 8:
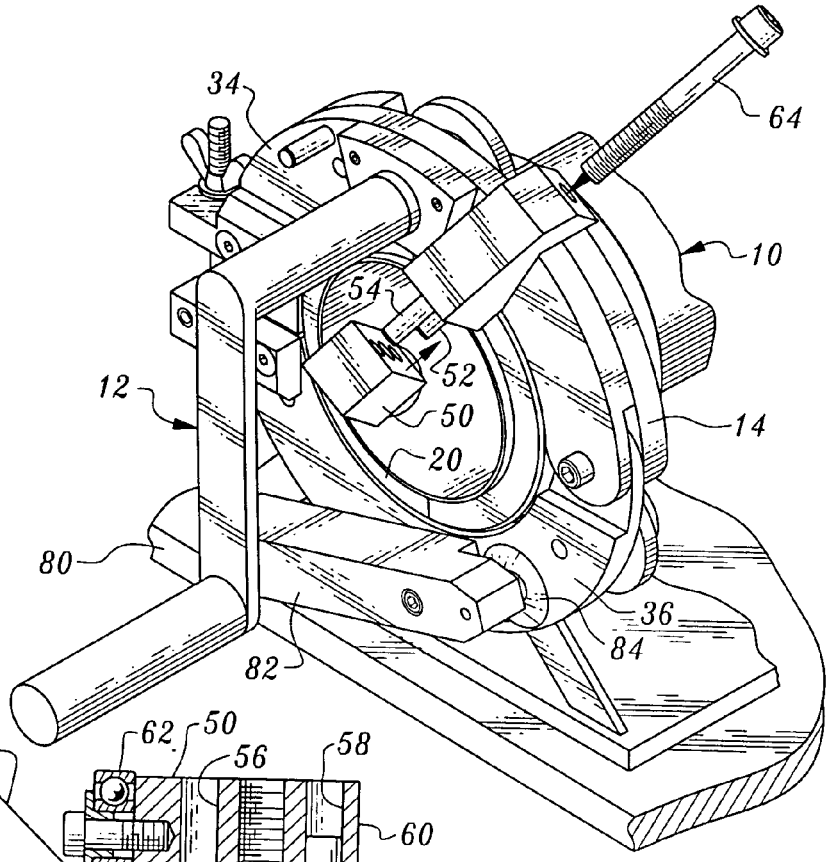
FIG. 8 is a rear, perspective view illustrating the flange forming tool of the apparatus prior to its placement on the holding fixture.
Figure 9:
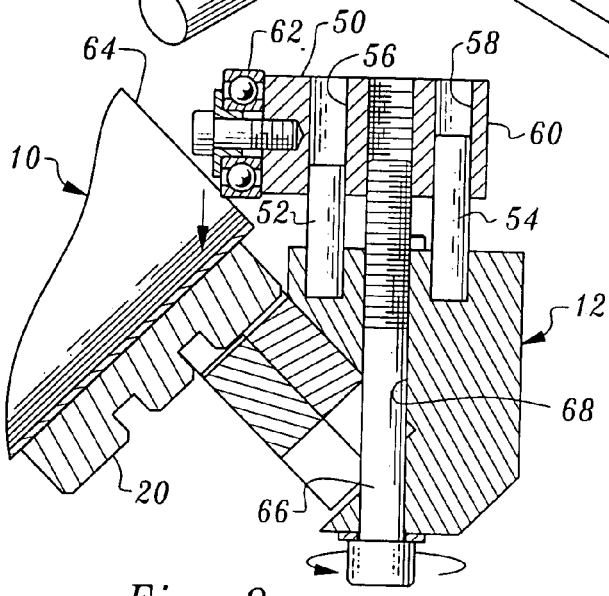
FIG. 9 is an enlarged, cross-sectional view illustrating portions of the apparatus including the flange forming tool in relation to the conduit end and preparatory to the flange forming tool engaging the conduit end.
Figure 10:
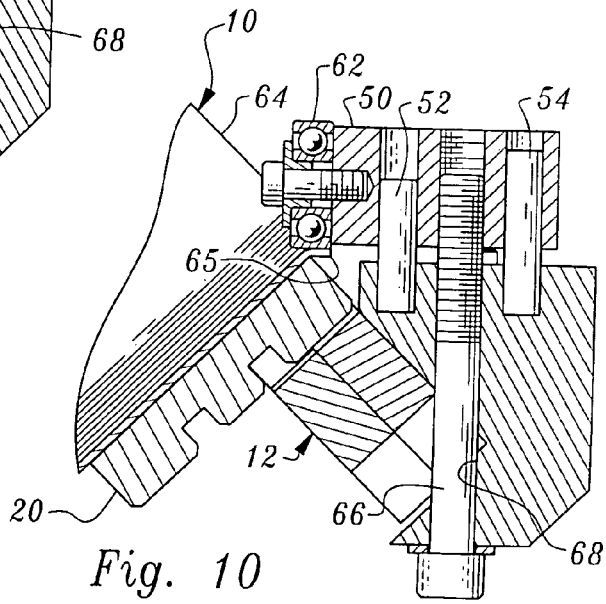
FIG. 10 is a view similar to FIG. 9, but illustrating the flange forming tool engaging the conduit end to initiate formation of a flange therein.
Figure 12:
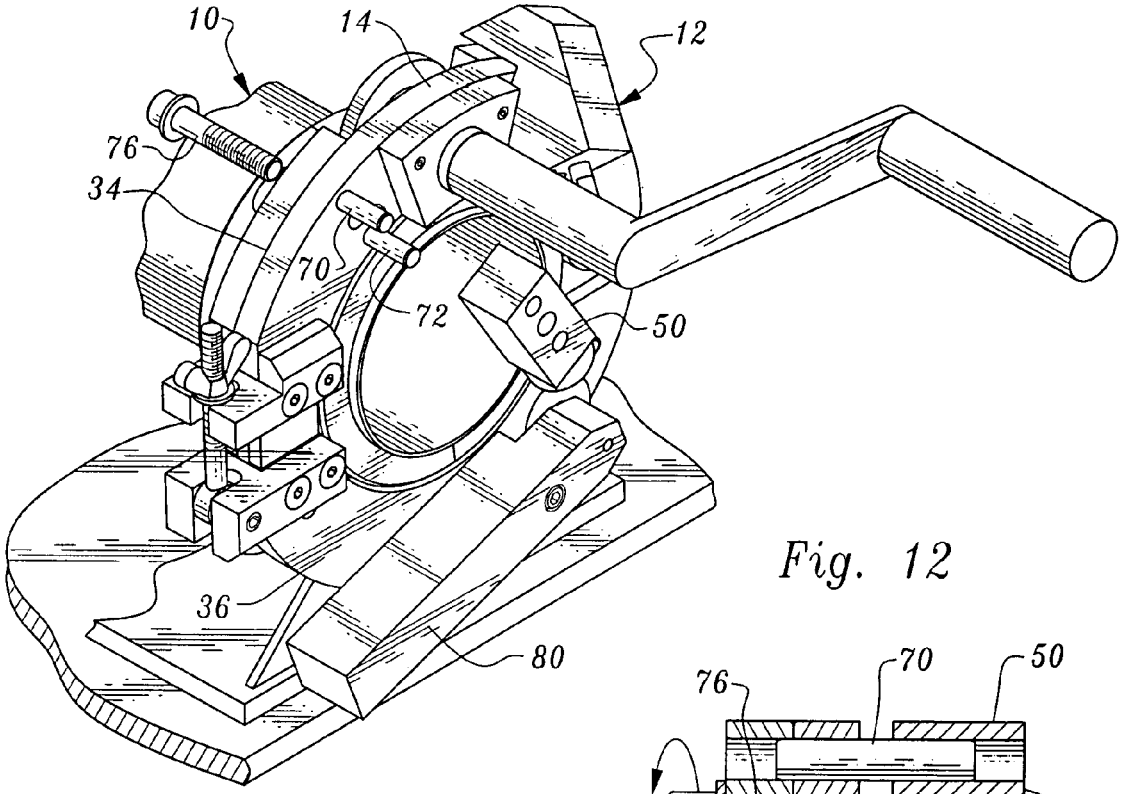
FIG. 12 is a rear, perspective view illustrating the flange forming tool prior to connection to the holding fixture at an alternate location on the holding fixture.
Figure 13:
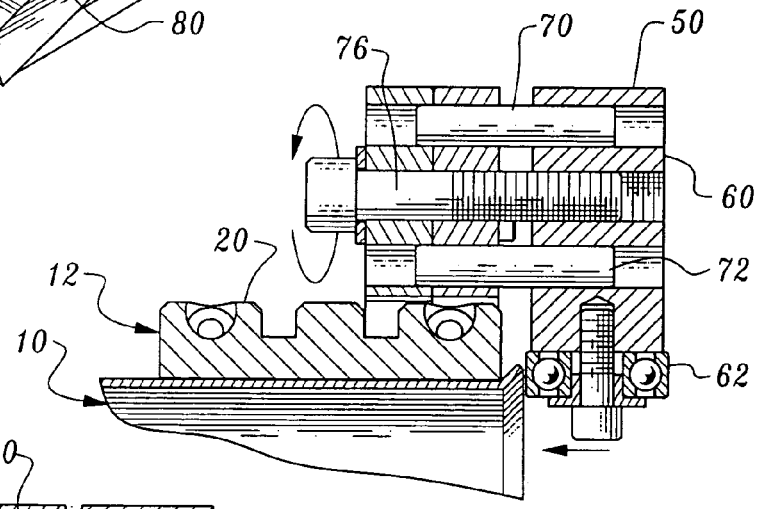
FIG. 13 is a greatly enlarged, cross-sectional view showing the flange forming tool at the alternate location and prior to engagement of the tool with the flange formed during the first stage of the flange formation operation.
Figure 14:
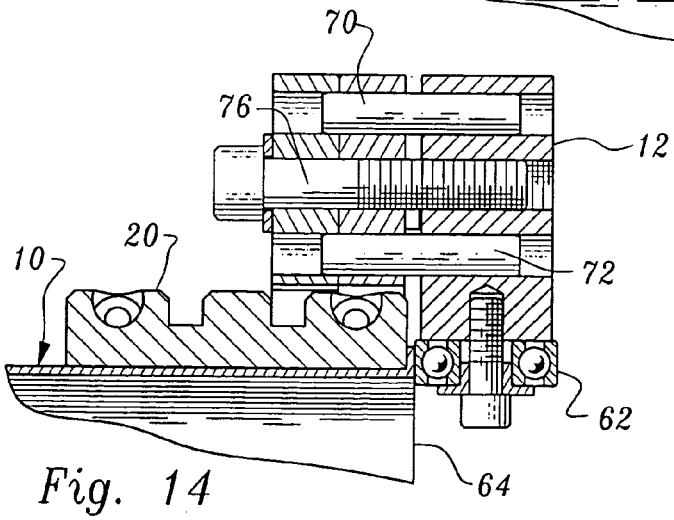
FIG. 14 is a view similar to FIG. 13, but illustrating the flange forming tool engaging the end of the conduit to complete formation of the flange.
Figure 15:
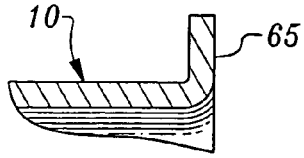
FIG. 15 is a greatly enlarged, cross-sectional view illustrating a segment of the end of the conduit with the completed flange.

A flange forming tool 50 is connected to the holding fixture when a flange is to be formed in the conduit. FIG. 8 shows the flange forming tool prior to connection thereof to the holding fixture, and FIGS. 9 and 10 show the flange forming tool 50 connected to the holding fixture. More particularly, tool supports in the form of shafts 52, 54 project outwardly from the holding fixture and are parallel and spaced from one another, projecting in the same direction. These shafts 52, 54 are positioned in throughbores 56, 58 formed in the main body 60, the main body 60 being slidably movable relative to the shafts 52, 54. A rotatable flange tool roller 62 is attached at an end of main body 60.

Figure 11:
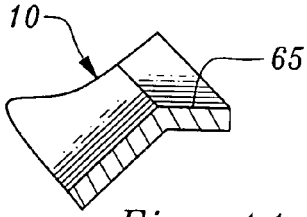
FIG. 11 is a greatly enlarged, cross-sectional view showing a portion of the conduit end after the flange forming tool has initiated formation of a flange thereon during a first part of the flange forming operation.

The flange tool roller 62 is engageable with an end 64 of the conduit 10 as shown in FIG. 10 to initiate formation of a flange 65 at the conduit end. The flange forming tool 50 is so oriented that it forms an approximately 45 degree bend at the conduit end as shown in FIGS. 10 and 11. Movement of the flange forming tool is accomplished by tool moving structure in the form of a threaded member 66 threadedly engaged with main tool body 60 and passing through a througbore 68 formed in holding fixture 14. FIG. 9 shows the flange tool roller 62 prior to engagement with the conduit end and FIG. 10 illustrates how rotation of the threaded member 66 tightens the flange tool roller 62 against the conduit end adjacent to the collar to form the bend shown in FIGS. 10 and 11.

One of the novel aspects of the apparatus is the fact that the flange forming tool 50 is selectively alternatively positionable on alternative tool supports projecting from the holding fixture whereby the flange forming tool can engage the end of conduit 10 at alternative orientations. FIGS. 12–15 illustrate how the flange forming tool 50 is applied to tool supports in the form of shafts 70, 72 which project from holding fixture 14 at locations differing from those of shafts 52, 56. The shafts 70, 72 are parallel to and spaced from one another but project in a direction differing from the direction of projection of shafts 52, 54. In this arrangement a threaded member 76 which is shorter than threaded member 66 is threadedly engaged with the tool main body 60 and passes through holding fixture 14. Rotation of the threaded member 76 relative to the holding fixture and the flange forming tool will draw flange tool roller 62 into engagement with the 45 degree flange previously formed and bend the flange completely to its desired 90 degree orientation relative to the conduit central longitudinal axis.

Prior to formation of flange 65, it may be necessary or desirable to cut the conduit 10. This may be done, for example, to change its length or cut off a damaged or threaded end portion to present a conduit end which is undamaged and smooth. This may be accomplished by the apparatus 12, if desired. The apparatus 12 includes a conduit cutter 80 in the form of an actuator lever 82 pivotally attached to the holding fixture and a cutter wheel 84 rotatably connected to the actuator lever at a location spaced from the location of pivotal interconnection between the actuator lever and the holding fixture.

Figure 7:
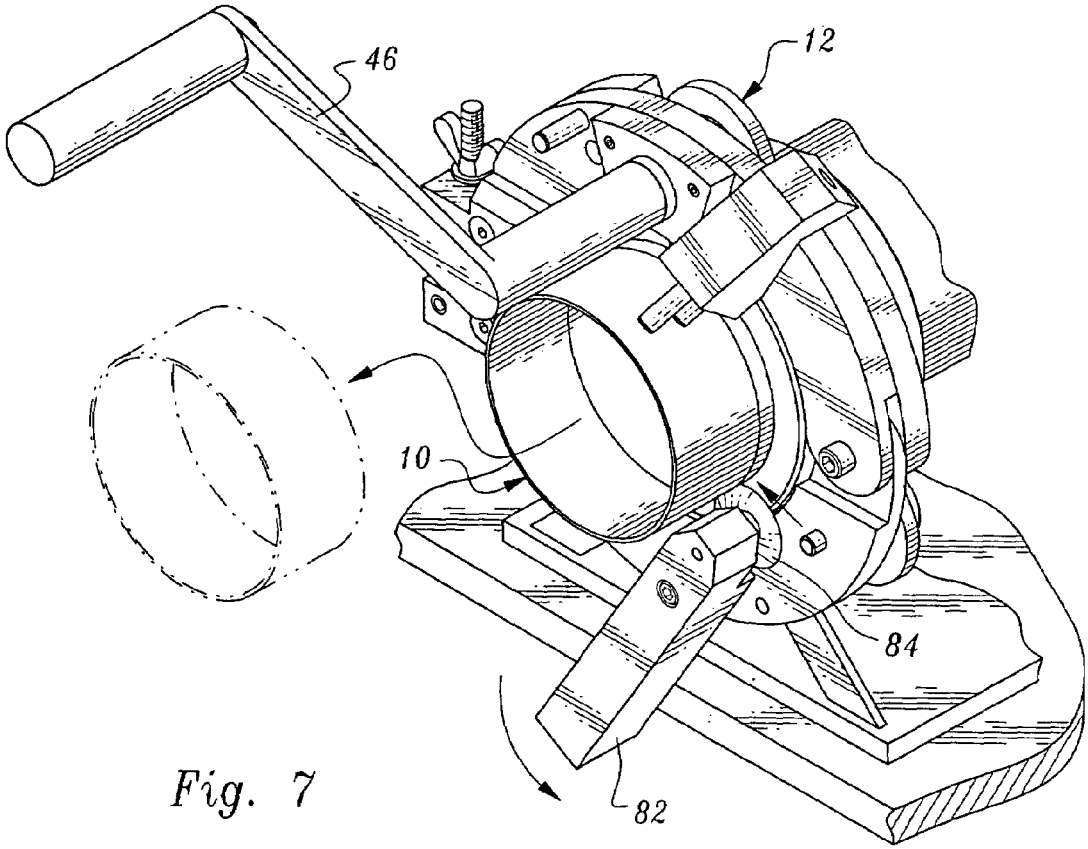
FIG. 7 is a rear view of the apparatus illustrating a cut being made in the conduit to form an end, the cut-off portion of the conduit being illustrated in phantom.

When one wishes to cut away a portion of the conduit to form a uniform and undamaged end, the handle 46 is rotated to rotate the collar and conduit as previously described. While this is occurring, the operator uses the actuator lever 82 to apply pressure to the conduit with the cutter wheel 84 until the desired portion of the conduit is separated to form a conduit end suitable for flange formation. This is shown in FIG. 7, the removed portion being shown in phantom lines.

The invention claimed is:

1. Apparatus for shaping a conduit to form a radially outwardly projecting flange at an end thereof, said apparatus comprising, in combination:

a holding fixture including rotatable support members and defining an opening receiving said conduit;

a collar releasably attached to said conduit to prevent relative rotational movement between said collar and conduit and surrounding said conduit, said collar disposed in said opening and rotatable supported by the rotatable support members of said holding fixture;

rotation imparting structure connected to said holding fixture directly engaging said collar and for simultaneously rotating said collar and said conduit relative to said holding fixture; and a flange forming tool operatively associated with said holding fixture engaging said conduit at said end and operable to apply bending forces to said conduit to form a radially outwardly extending flange at said end upon simultaneous rotation of said collar and said conduit by said rotation imparting structure.

2. The apparatus according to claim 1 additionally comprising a conduit cutter operatively associated with said holding fixture for cutting said conduit to form said end upon rotation of said collar and said conduit by said rotation imparting structure prior to formation of said flange by said flange forming tool.

3. The apparatus according to claim 1 wherein said holding fixture comprises pivoted fixture segments relatively movable between a first configuration wherein said fixture segments substantially completely surround said collar and said conduit and a second configuration wherein said fixture segments do not substantially completely surround said collar and conduit, said fixture segments when in said second configuration facilitating selective insertion of said collar and said conduit into said opening or removal of said collar and said conduit from said opening, said apparatus including a lock operatively associated with said fixture segments to lock said fixture segments in said first configuration.

4. The apparatus according to claim 2 wherein said conduit cutter comprises an actuator lever pivotal relative to said holding fixture and a cutter wheel rotatably connected to said actuator lever.

5. The apparatus according to claim 1 wherein said collar comprises a plurality of selectively releasably connected collar segments.

6. Apparatus for shaping a conduit to form a radially outwardly projecting flange at an end thereof, said apparatus comprising, in combination:

holding fixture defining an opening receiving said conduit;

a collar releasably attached to said conduit and surrounding said conduit, said collar disposed in said opening and supported by said holding fixture;

rotation imparting structure operatively associated with said holding fixture engaging said collar and for simultaneously rotating said collar and said conduit; and a flange forming tool operatively associated with said holding fixture engaging said conduit at said end and operable to apply bending forces to said conduit to form a radially outwardly extending flange at said end upon rotation of said collar and said conduit by said rotation imparting structure, said collar having an outer periphery and defining a circular indent extending completely about said outer periphery, and said holding fixture including rotatable tracking wheels positioned in said circular indent and rotatably supporting said collar and said conduit for rotation about the central longitudinal axis of said conduit.

7. The apparatus according to claim claim 6 wherein said rotation imparting structure comprises a handle attached to at least one of said rotatable tracking wheels to rotatingly drive said at least one rotatable tracking wheel, frictional engagement between said driven at least one rotatable tracking wheel and said collar causing rotation of said collar and said conduit.

8. Apparatus for shaping a conduit to form a radially outwardly projecting flange at an end thereof, said apparatus comprising, in combination:

a holding fixture defining an opening receiving said conduit;

a collar releasably attached to said conduit and surrounding said conduit, said collar disposed in said opening and supported by said holding fixture;

rotation imparting structure operatively associated with said holding fixture engaging said collar and for simultaneously rotating said collar and said conduit;

a flange forming tool operatively associated with said holding fixture engaging said conduit at said end and operable to apply bending forces to said conduit to form a radially outwardly extending flange at said end upon rotation of said collar and said conduit by said rotation imparting structure, said flange forming tool movably mounted relative to said holding fixture, said collar and said conduit; and tool moving structure operatively associated with said flange forming tool for selectively moving said flange forming tool relative to said holding fixture, said collar and said conduit while engaging said conduit at said end during rotation of said collar and conduit, said tool moving structure including a threaded member threadedly engaged with said flange forming tool and extending at least partially through said holding fixture, rotation of said threaded shaft moving said flange forming tool, said flange forming tool being slidably mounted on said at least one tool support, and a plurality of tool supports projecting outwardly from said holding fixture, said tool supports being spaced from one another and projecting in different directions, said flange forming tool being selectively alternatively positionable on said tool supports whereby said flange forming tool can engage said conduit at different alternative orientations.

9. The apparatus according to claim 8 wherein said flange forming tool includes a rotatable flange tool roller engageable with said conduit.

* * * * *